US011217894B2

(12) United States Patent
Chou et al.

(10) Patent No.: US 11,217,894 B2
(45) Date of Patent: Jan. 4, 2022

(54) ANTENNA STRUCTURE

(71) Applicants: CYNTEC CO., LTD., Hsinchu (TW); National Taiwan University, Taipei (TW)

(72) Inventors: Sheng-Ju Chou, Hsinchu (TW); Hsi-Tseng Chou, Taipei (TW); Ping-Chang Huang, Hsinchu (TW)

(73) Assignees: CYNTEC CO., LTD., Hsinchu (TW); National Taiwan University, Taipei (TW)

( * ) Notice: Subject to any disclaimer, the term of this patent is extended or adjusted under 35 U.S.C. 154(b) by 14 days.

(21) Appl. No.: 16/882,565

(22) Filed: May 25, 2020

(65) Prior Publication Data

US 2020/0381835 A1 Dec. 3, 2020

Related U.S. Application Data

(60) Provisional application No. 62/854,962, filed on May 30, 2019.

(51) Int. Cl.

| | |
|---|---|
| ***H01Q 1/24*** | (2006.01) |
| ***H01Q 9/28*** | (2006.01) |
| ***H01Q 9/04*** | (2006.01) |
| ***H01Q 9/32*** | (2006.01) |
| ***H01Q 21/24*** | (2006.01) |
| ***H01Q 1/38*** | (2006.01) |
| ***H01Q 15/14*** | (2006.01) |

(52) U.S. Cl.

CPC ..... *H01Q 9/285* (2013.01); *H01Q 1/243* (2013.01); *H01Q 1/38* (2013.01); *H01Q 9/0407* (2013.01); *H01Q 9/32* (2013.01); *H01Q 15/14* (2013.01); *H01Q 21/24* (2013.01)

(58) Field of Classification Search

CPC ..... H01Q 21/24; H01Q 15/14; H01Q 9/32; H01Q 9/0407; H01Q 1/38; H01Q 1/243; H01Q 9/285

See application file for complete search history.

(56) References Cited

U.S. PATENT DOCUMENTS

| | | | |
|---|---|---|---|
| 9,799,963 | B2 | 10/2017 | Huang |
| 10,424,831 | B2 | 9/2019 | Hsu |
| 10,862,211 | B2 | 12/2020 | Pu |

FOREIGN PATENT DOCUMENTS

| | | | |
|---|---|---|---|
| CN | 206564336 | U | 10/2017 |
| TW | I572093 | B | 2/2017 |
| TW | I643405 | B | 12/2018 |
| TW | 202010180 | A | 3/2020 |

*Primary Examiner* — Graham P Smith
(74) *Attorney, Agent, or Firm* — Winston Hsu

(57) ABSTRACT

A antenna structure including a reflector, a horizontally polarized antenna and a vertically polarized antenna on the front side of reflector, wherein the horizontally polarized antenna is made up of a pair of dipoles, each said dipole includes a positive ground member and a negative ground member overlapping each other, while the vertically polarized antenna is made of a upper ground member and a lower ground member overlapping each other, and the upper ground member is above the upper dipole and the lower ground member is below the lower dipole, and a first signal source and a second signal source extend from the back side of the reflector to the front side to excite the horizontally polarized antenna and the vertically polarized antenna, respectively.

16 Claims, 10 Drawing Sheets

ANTENNA STRUCTURE

CROSS REFERENCE TO RELATED APPLICATIONS

This application claims the benefit of U.S. Provisional Patent Application No. 62/854,962, filed May 30, 2019, which is incorporated by reference herein in its entirety.

BACKGROUND OF THE INVENTION

1. Field of the Invention

The present invention relates generally to an antenna structure, and more specifically, to an antenna structure with integrated horizontally polarized antenna and vertically polarized antenna.

2. Description of the Related Art

As mobile communication technologies develop, an electronic device, which is equipped with an antenna module, such as a smartphone, a wearable device, or the like is widely supplied. The electronic device may receive or transmit a signal including data (e.g., a message, a photo, a video, a music file, a game, and the like) through the antenna.

The antenna module of the electronic device is implemented using a plurality of antenna elements for the purpose of receiving or transmitting a signal more efficiently. For example, the electronic device may include one or more antenna arrays in each of which a plurality of antenna elements are arranged in a regular shape. A signal that is received by an electronic device may be polarized in a specific direction. To receive or transmit a vertically polarized signal or a horizontally polarized signal, the electronic device may physically separate the plurality of paths based on a direction in which a signal is polarized.

Next-generation wireless communication technologies, like 5G mobile networks or wireless system, may use a millimeter wave (mmWave) which is substantially greater than or equal to 20 GHz. In order to overcome a high free space loss due to a frequency characteristic and to increase an antenna gain, specific horizontally polarized antennas and specific vertically polarized antennas are required to receive and transmit vertically polarized signal or horizontally polarized signal respectively. In addition, to ensure a 360° coverage at the time of mm-wave communication, the antenna device is preferably mounted on an edge portion of the electronic device, such as a corner portion of the circuit board. However, while the electronic device is gradually becoming slimmer, the thin thickness as compared to the longitudinal size thereof may not provide a sufficient length or is not easy to be implemented for vertically polarized antennas as well as to design a required frequency, and at least some regions of the antenna modules and circuit module may overlap or be placed too closer each other. When a plurality of antenna modules are installed along the periphery of a board, a polarization loss due to the interference between adjacent antenna modules is expected. Thus, when the antenna modules are mounted, it is necessary for the antenna modules to be spaced apart from each other by a predetermined spacing which unavoidably causes the integration of the antenna modules to be degraded.

The above information is presented as background information only to assist with an understanding of the present disclosure. No determination has been made, and no assertion is made, as to whether any of the above might be applicable as prior art with regard to the present disclosure.

Accordingly, there is a need for an improved antenna structure with well-integrated horizontally and vertically polarized antennas arrangement to provide dual polarized transmission in confined space and prevent the interference between adjacent antenna modules.

SUMMARY OF THE INVENTION

In order to meet the requirement of next-generation wireless communication, the present invention hereby provides an antenna structure with well-integrated horizontally polarized antenna module and vertically polarized antenna module to provide optimized radiation performance of the antenna module in dual polarization manner without mutual interference and make the best use of confined space in compact electronic devices.

The aspect of present invention is to provide an antenna structure, including a reflector dividing said antenna structure into a front side and a back side, a horizontally polarized antenna on said front side of said reflector, wherein said horizontally polarized antenna comprises a pair of dipoles at least partially overlapping each other, and each said dipole comprises a positive ground member and a negative ground member separated by a slot, a first signal source extending from a back side of said reflector to said front side through a first opening of said reflector, wherein said first signal source extends between said dipoles and extends from one overlapping interval between said positive ground members of said dipoles to another overlapping interval between said negative ground members of said dipoles across said slot to excite said horizontally polarized antenna, a vertically polarized antenna on said front side of said reflector, wherein said vertically polarized antenna comprises a upper ground member and a lower ground member at least partially overlapping each other, wherein said upper ground member is above upper said dipole and said lower ground member is below lower said dipole, and a second signal source extending from said back side of said reflector to said front side through a second opening of said reflector, wherein said second signal source extends between said upper ground member and said lower ground member and extends vertically toward one of said upper ground member and said second lower ground member to excite said vertically polarized antenna.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The accompanying drawings are included to provide a further understanding of the embodiments, and are incorporated in and constitute apart of this specification. The drawings illustrate some of the embodiments and, together with the description, serve to explain their principles. In the drawings.

Figure 1:
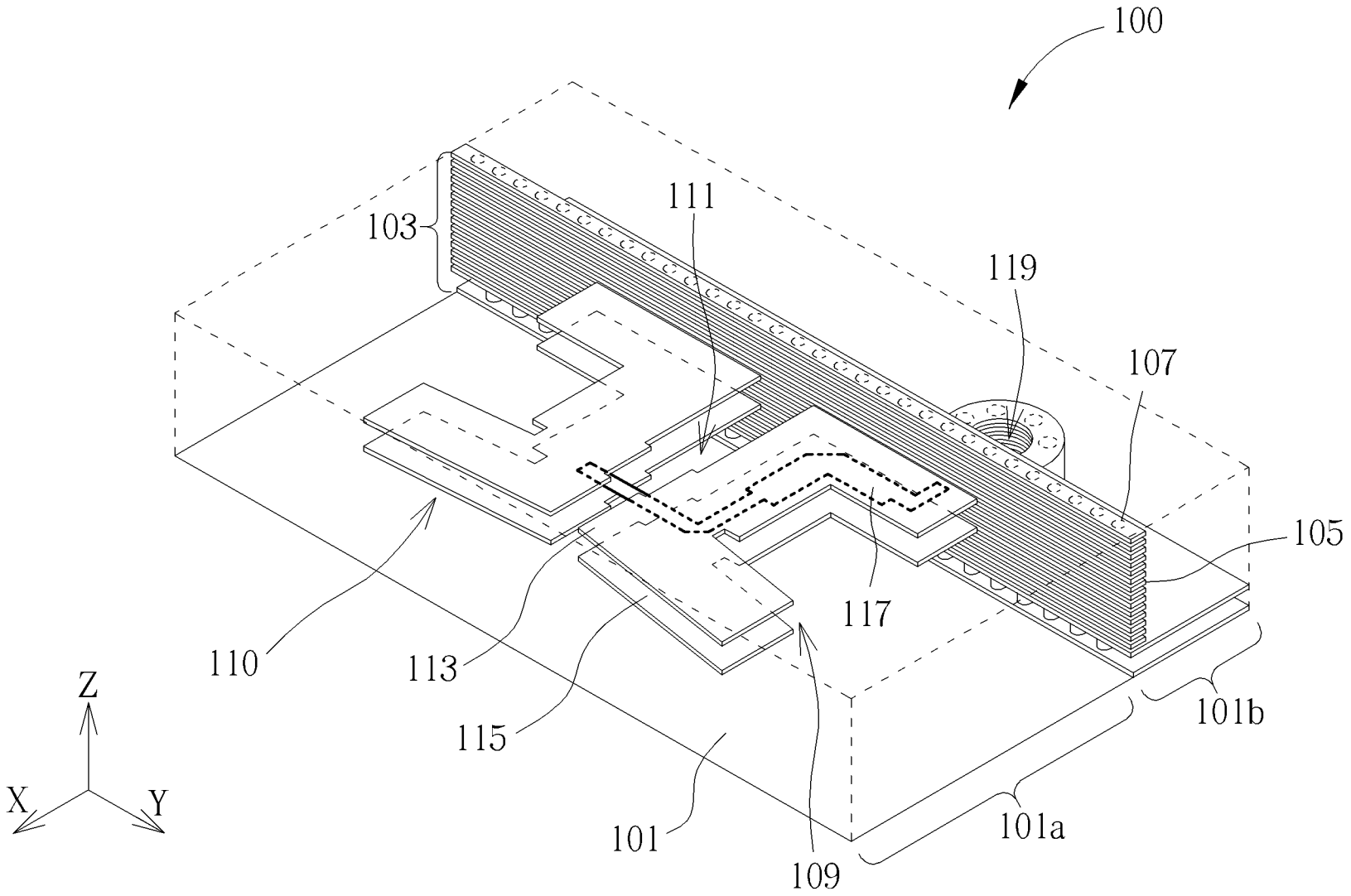
FIG. 1 is a schematic perspective view of the horizontally polarized antenna module in accordance with one embodiment of the present invention.

It should be noted that all the figures are diagrammatic. Relative dimensions and proportions of parts of the drawings have been shown exaggerated or reduced in size, for the sake of clarity and convenience in the drawings. The same reference signs are generally used to refer to corresponding or similar features in modified and different embodiments.

DETAILED DESCRIPTION

In following detailed description of the present invention, reference is made to the accompanying drawings which form a part hereof and is shown by way of illustration and specific embodiments in which the invention may be practiced. These embodiments are described in sufficient details to enable those skilled in the art to practice the invention. Dimensions and proportions of certain parts of the drawings may have been shown exaggerated or reduced in size, for the sake of clarity and convenience in the drawings. Other embodiments may be utilized and structural, logical, and electrical changes may be made without departing from the scope of the present invention. The following detailed description, therefore, is not to be taken in a limiting sense, and the scope of the present invention is defined by the appended claims.

As used in various embodiments of the present disclosure, the expressions "include", "may include" and other conjugates refer to the existence of a corresponding disclosed function, operation, or constituent element, and do not limit one or more additional functions, operations, or constituent elements. Further, as used in various embodiments of the present disclosure, the terms "include", "have", and their conjugates are intended merely to denote a certain feature, numeral, step, operation, element, component, or a combination thereof, and should not be construed to initially exclude the existence of or a possibility of addition of one or more other features, numerals, steps, operations, elements, components, or combinations thereof.

Spatially relative terms, such as "beneath," "below," "lower," "above," "upper," and the like, may be used herein for ease of description to describe one element or feature's relationship to another element(s) or feature(s) as illustrated in the figures. It should be readily understood that these meanings such as "on," "above," and "over" in the present disclosure should be interpreted in the broadest manner such that "on" not only means "directly on" something but also includes the meaning of "on" something with an intermediate feature or a layer therebetween, and that "above" or "over" not only means the meaning of "above" or "over" something but can also include the meaning it is "above" or "over" something with no intermediate feature or layer therebetween (i.e., directly on something).

While expressions including ordinal numbers, such as "first" and "second", as used in various embodiments of the present disclosure may modify various constituent elements, such constituent elements are not limited by the above expressions. For example, the above expressions do not limit the sequence and/or importance of the elements. The above expressions are used merely for the purpose of distinguishing an element from the other elements. For example, a first user device and a second user device indicate different user devices although both of them are user devices. For example, a first element may be termed a second element, and likewise a second element may also be termed a first element without departing from the scope of various embodiments of the present disclosure.

It should be noted that if it is described that an element is "coupled" or "connected" to another element, the first element may be directly coupled or connected to the second element, and a third element may be "coupled" or "connected" between the first and second elements. Conversely, when one component element is "directly coupled" or "directly connected" to another component element, it may be construed that a third component element does not exist between the first component element and the second component element.

An electronic device according to various embodiments of the present disclosure may be a device having a function that is provided through various colors emitted depending on the states of the electronic device or a function of sensing a gesture or bio-signal. For example, the electronic device may include at least one of a smart phone, a tablet personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, a wearable device (e.g., a head-mounted-device (HMD) such as electronic glasses, electronic clothes, an electronic bracelet, an electronic necklace, an electronic appcessory, an electronic tattoo, or a smart watch).

Figure 2:
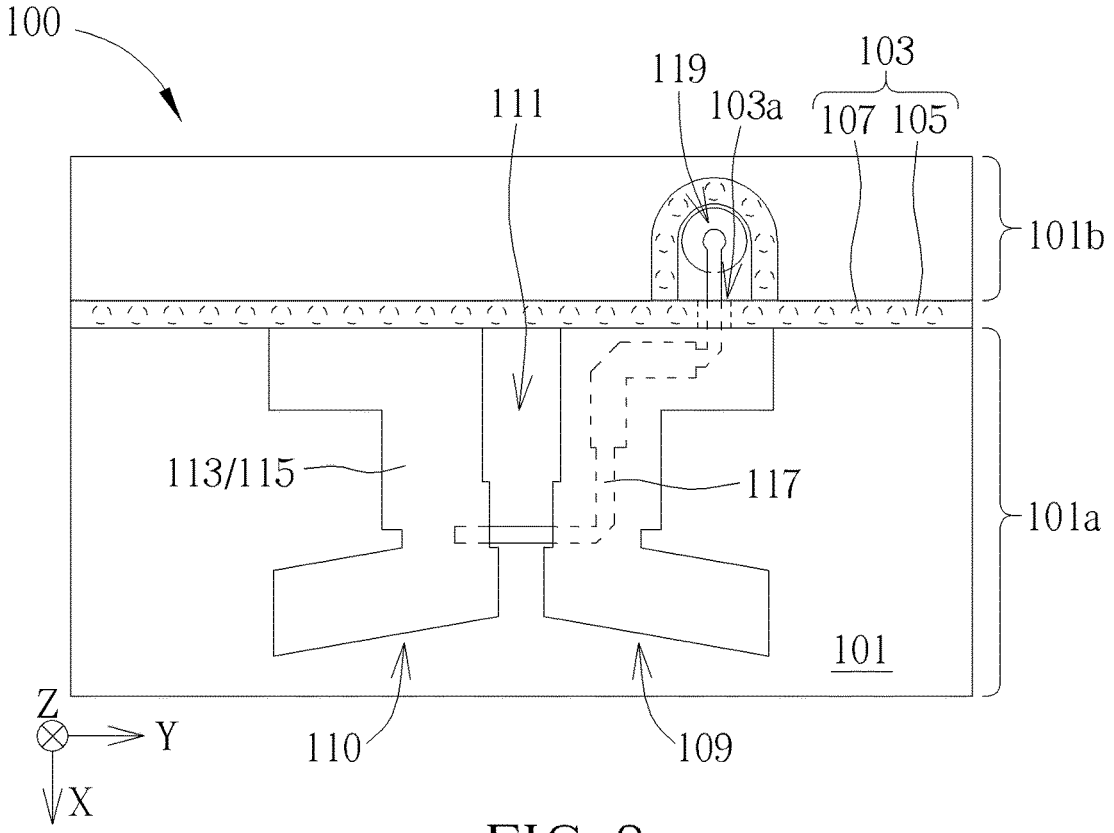
FIG. 2 is a schematic top view of the horizontally polarized antenna module in accordance with one embodiment of the present invention.
Figure 3:
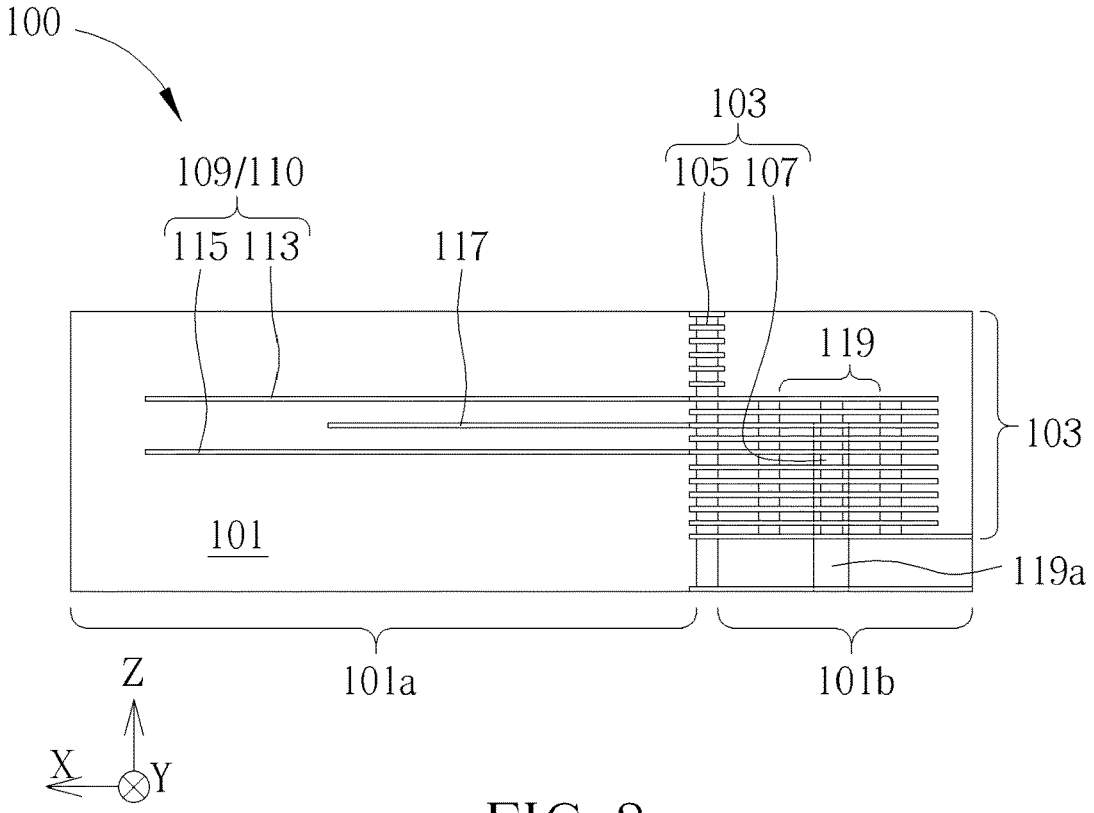
FIG. 3 is a schematic cross-sectional view of the horizontally polarized antenna module in accordance with one embodiment of the present invention.
Figure 4:
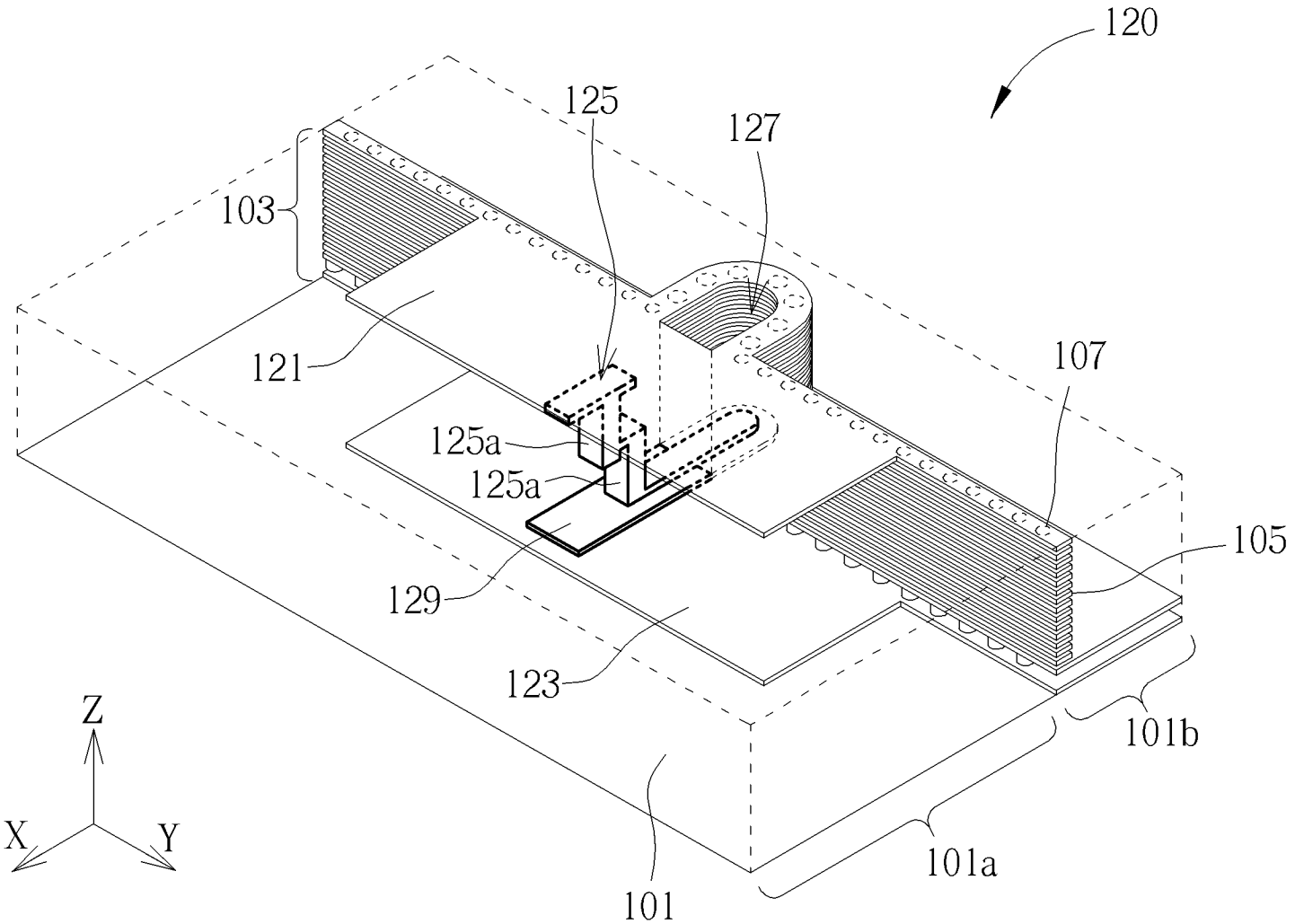
FIG. 4 is a schematic perspective view of the vertically polarized antenna module in accordance with one embodiment of the present invention.
Figure 5:
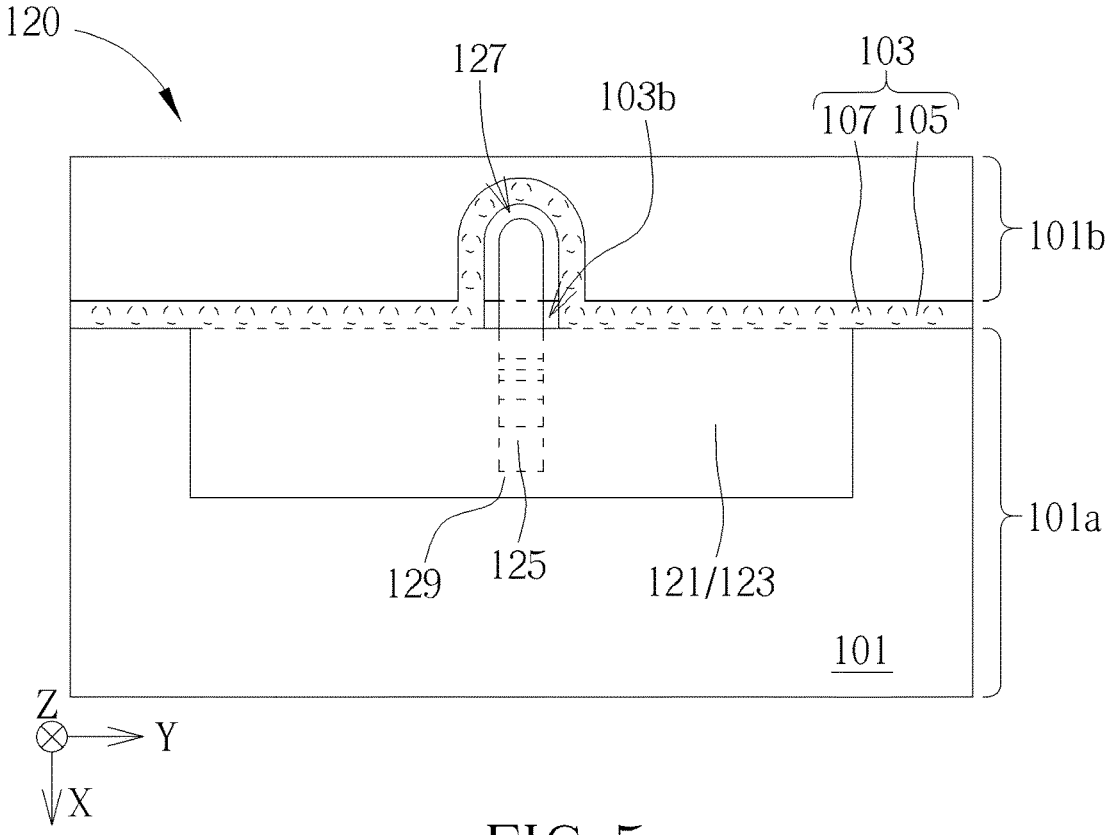
FIG. 5 is a schematic top view of the vertically polarized antenna module in accordance with one embodiment of the present invention.
Figure 6:
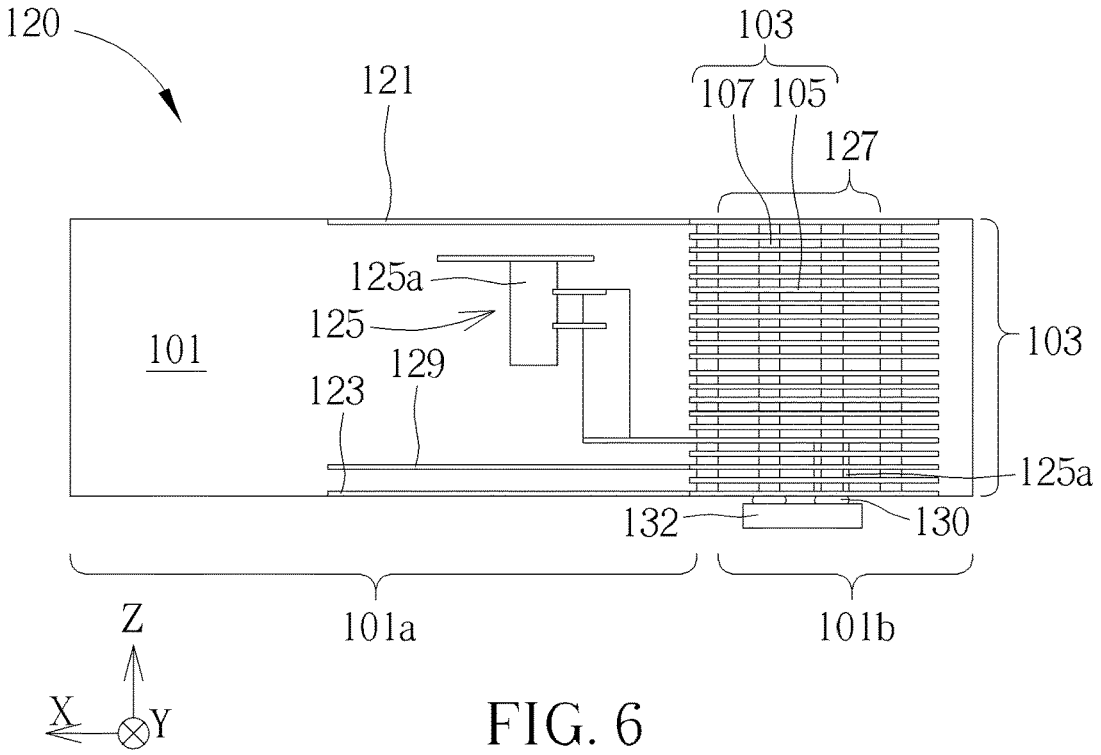
FIG. 6 is a schematic cross-sectional view of the vertically polarized antenna module in accordance with one embodiment of the present invention.
Figure 7:
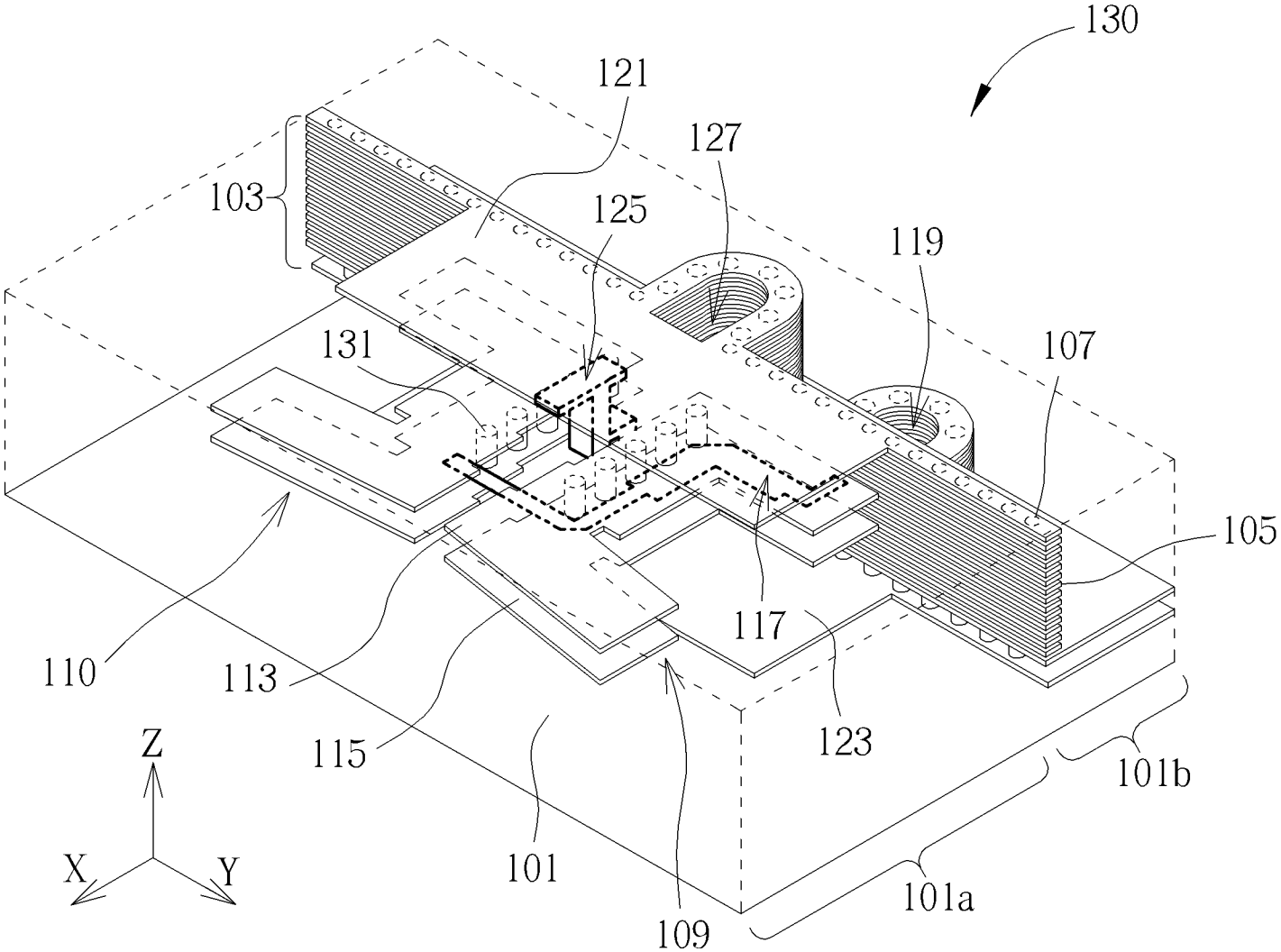
FIG. 7 is a schematic perspective view of the multilayer stacked antenna structure with integrated horizontally polarized antenna module and vertically polarized antenna module in accordance with one embodiment of the present invention.
Figure 8:
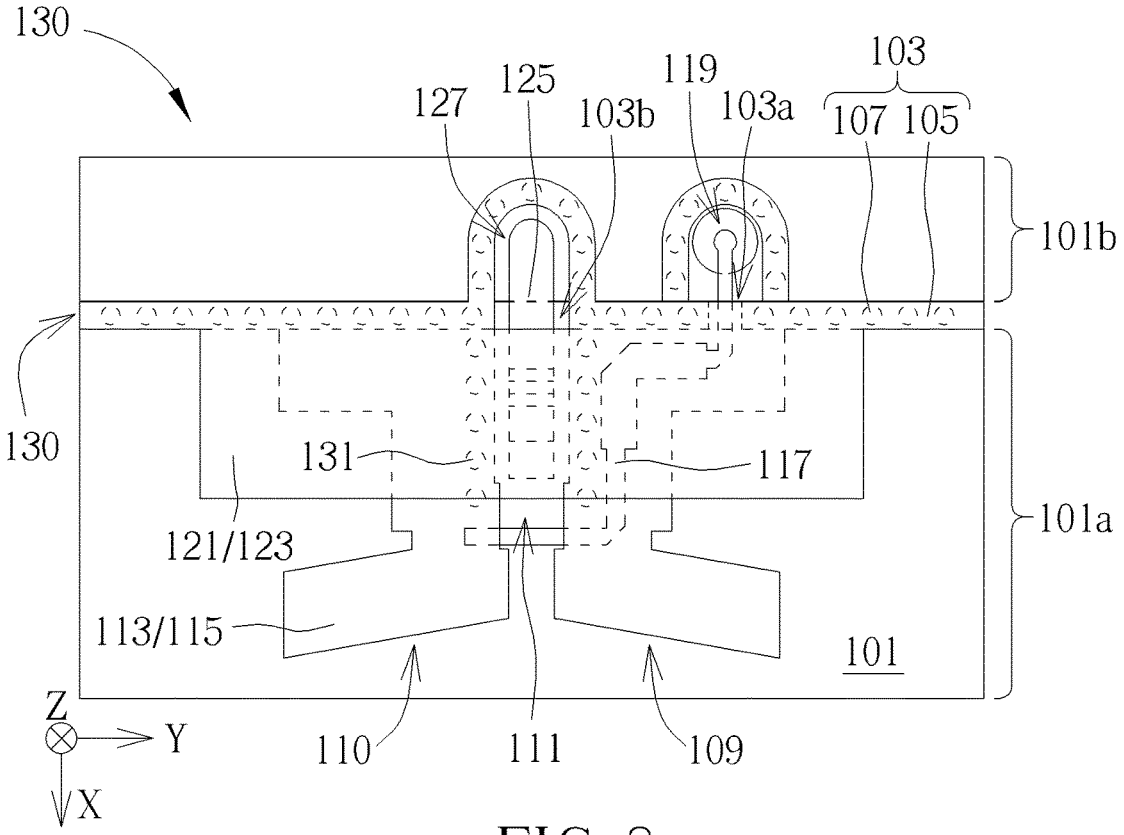
FIG. 8 is a schematic top view of the multilayer stacked antenna structure with integrated horizontally polarized antenna module and vertically polarized antenna module in accordance with one embodiment of the present invention.
Figure 9:
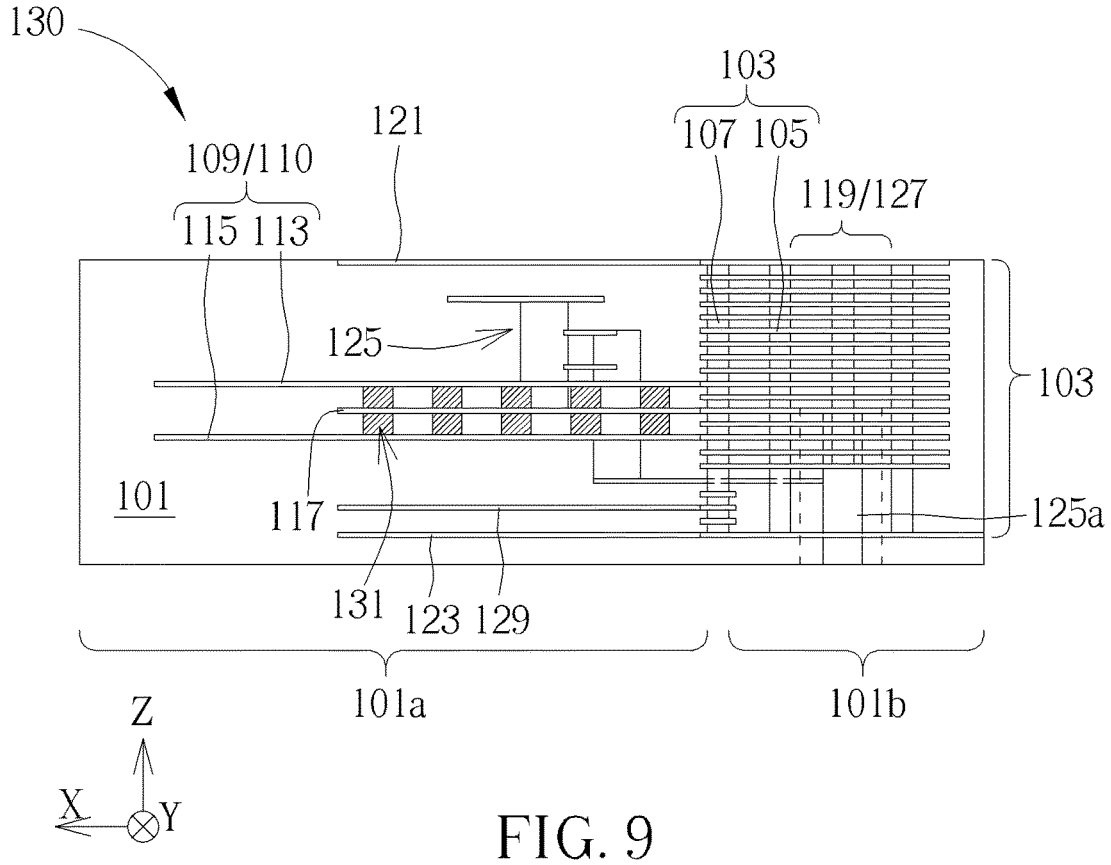
FIG. 9 is a schematic cross-sectional view of the multilayer stacked antenna structure with integrated horizontally polarized antenna module and vertically polarized antenna module in accordance with one embodiment of the present invention.

Hereinafter, a concept of an antenna structure according to various embodiments of the present disclosure may be described with reference to FIGS. 1-12, wherein FIGS. 1-3 schematically illustrate a horizontally polarized antenna portion in the antenna structure, FIGS. 4-6 schematically illustrate a vertically polarized antenna portion in the antenna structure, and FIGS. 7-9 schematically illustrate entire antenna structure with the integrated horizontally polarized antenna portion and vertically polarized antenna portion.

Please refer to FIGS. 1-3, the horizontally polarized antenna structure 100 in perspective view, top view and cross-sectional view are provided respectively according to the preferred embodiment of the present disclosure. The antenna structure 100 of present disclosure may be formed in a substrate 101 through ordinary photolithography processes, PCB (Printed Circuit Board) manufacturing process or LTCC (low-temperature co-fired ceramic) manufacturing process. The substrate 101 may be provided to support, fix and protect the members of antenna structure 100, with low loss tangent and proper dielectric constants to fulfill the requirement of antenna miniaturization and achieve desired wavelength and speed of propagation of a wave through the medium of substrate 101. The substrate 101 may be a flexible printed circuit board or a dielectric board, made of electrically insulating materials including but not limited to FR4, PPO (polyphenylene oxide), BT (Bismaleimide Triazine), CEM (Composite Epoxy Material) resin, glass fiber, ceramic and PTFE (Polytetrafluoroethene). The integrated antenna of the present invention may be implemented in either a non-multilayer form or a multilayer form. For example, every component may be first fabricated and then be combined or moulded on or within a supporting structure (ex. phone case).

Refer still to FIGS. 1-3. A wall-type reflector 103 is formed in the substrate 101. The reflector 103 serves to reflect electromagnetic waves radiating by the radiator, increasing gain in a given direction. The reflector 103 in the embodiment of present invention is made up of multiple stacked metal layers 105 connected by first vias 107. The stacked metal layers 105 may be common copper films, laminated alternatively with insulating layers in a form of copper-clad laminate (CCL). The pattern of each metal layer 105 and via holes between the metal layers 105 may be formed and defined individually by photolithography, drilling or screen printing. With via holes penetrating vertically through every metal layer 105 and filled with conductive material like copper, multiple first vias 107 is formed regularly and densely connecting and cooperating with every stacked metal layer 105 to create a wall structure for reflecting wave radiated by the radiator. In some embodiment, the reflector 103 may include more than one aforementioned wall structures, with first vias 107 arranged and connected alternatively therebetween. In some embodiment, the reflector 103 may be in a shape of flat, curved or irregular wall extending vertically without vias.

In the embodiment, the substrate 101 is divided by the reflector 103 into a front portion 101*a* for antenna modules and a back portion 101*b* for circuit modules. The radiator of the antenna module is formed from the stacked metal layers 105. Regarding the front portion 101*a*, the horizontally polarized antenna structure 100 in the preferred embodiment of present invention is a dipole antenna in stripline-type transmission to obtain better frequency band. The radiator is made up of a pair of dipoles, including an upper dipole 113 and a lower dipole 115 at least partially overlapping each other and spaced apart vertically by a predetermined spacing, allowing signal sources to extend therethrough and excite the radiator. Moreover, each dipole 113, 115 may further include a positive ground member 109 and a negative ground member 110 separated horizontally by and laterally symmetric with respect to a slot 111 in the middle of reflector 103.

As shown in FIG. 3, the positive ground member 109 and the negative ground member 110 may be parts (ex. the horizontally-extending portions) of the stacked metal layers 105 extending horizontally from the reflector 103, with their patterns defined concurrently with the reflector 103 by photolithography or screen printing. Preferably, the dipoles 113, 115 are set at a horizontal level half height of the reflector 103 to ensure effective energy reflection by the reflector 103. In the embodiment, the pattern of dipoles 109 is not limited to the one shown in FIG. 2. The positive ground member 109 and the negative ground member 110 are provided respectively with opposite extending structures in horizontally extending direction, to create a characteristic of 170-degree and 190-degree phase differences in the propagating/horizontal direction of electromagnetic wave from the first signal source 117, to generate energy radiation propagating in positive and negative Y-axis direction for horizontal polarization. The positive ground member 109 and the negative ground member 110 may be planes or in polygon shape. Preferably, when the positive ground member 109 and the negative ground member 110 are in horizontal symmetry, a 180-degree phase difference may be created to achieve best antenna characteristics. The pair of dipoles 113, 115 in vertically overlapping configuration may reduce the mutual and negative impact between horizontally polarized antenna and vertically polarized antenna, thus the two different antennas may be three-dimensionally integrated in the same space or position within the substrate 101.

Refer still to FIGS. 1-3. In addition to the dipoles 113 and 115, a first signal source 117 for horizontal polarization is provided in the antenna module. The first signal source 117 extends from the back portion 101*b* of the substrate 101 to the front portion 101*a* through a first opening 103*a* on the reflector 103, as shown in FIG. 2. More specifically, the path of first signal source 117 starts from one of the positive ground member 109 and the negative ground member 110, extends completely along the pattern between the upper dipole 113 and the lower dipole 115 and reaches the edge of the ground member 109 or 110 adjacent to the slot 111. The first signal source 117 would extend across the slot 111, preferably parallel between the pair of dipoles 113 and 115, and end up at the other ground member between the upper dipole 113 and the lower dipole 115. The energy emitted from the first signal source 117 would couple the dipole, i.e. the radiator, when crossing the slot 111 and is transmitted to the upper and lower dipoles 113, 115 thereof to generate resonance and radiation effect. Accordingly, the energy of electromagnetic wave is propagated in horizontally polarizing direction. As shown in FIG. 3, in the embodiment of present invention, the first signal source 117 may be apart of the metal layer 105 extending horizontally from the reflector 103, with its pattern defined concurrently with the reflector 103 by photolithography.

Refer still to FIGS. 1-3. Regarding the back portion 101*b*, a first shielding space 119 is formed by encircling multiple stacked metal layers 105 and first vias 107. In the embodiment, the first signal source 117 has a vertical portion 119*a* extending vertically from the bottom in the shielding space 119. The vertical portion 119*a* of the first signal source 117 and the encircling stacked metal layers 105 may establish a kind of coaxial cable transmission with better shielding and noise immune characteristics. One end of the vertical portion 119*a* extends horizontally to the front portion 101*a* of the substrate 101 through the first opening 103*a*, while the other end of the vertical portion 119*a* may electrically connect to the circuit module of the antenna, such as a radio frequency integrated circuit (RFIC) on the back portion 101*b* or a printed circuit board of an electronic communication device. The vertical portion 119*a* of first signal source 117 may be made up of multiple stacked vias formed in the same process as the first vias 107.

The embodiment described above is the concept of horizontally polarized antenna in the antenna structure of present invention. Now, please refer to FIGS. 4-6, which schematically illustrate the concept of vertically polarized antenna structure 120 in perspective view, top view and cross-sectional view respectively according to the preferred embodiment of the present disclosure.

Similar to the horizontal polarized antenna structure 100, the vertically polarized antenna structure 120 of present disclosure may be formed in the same substrate 101 as the horizontal polarized antenna structure 101 through ordinary semiconductor processes. The same wall-type, multilayer stacked reflector 103 is formed in the substrate 101 to reflect electromagnetic waves radiating by signal sources, increasing gain in a given direction. The radiator of the vertically polarized antenna module is also formed from the metal layers 105, however, with different shape and arrangement from the horizontal polarized ones.

Refer still to FIGS. 4-6, the vertically polarized antenna structure 120 in the preferred embodiment of present invention is a magnetoelectric (ME) antenna, different from the dipole antenna shown in previous embodiment. The radiator is made up of a rectangular upper ground member 121 and a lower ground member 123 partially or completely overlapping each other with same shape. The upper ground member 121 and the lower ground member 123 are spaced apart vertically by a predetermined spacing, allowing signal sources to extend therethrough and excite the radiator.

As shown in FIG. 6, the upper ground member 121 and the lower ground member 123, i.e. the radiator, may be parts of the stacked metal layers 105 extending horizontally from the reflector 103, with their patterns defined concurrently with the reflector 103 by photolithography. The spacing between the upper ground member 121 and the lower ground member 123 should be larger enough to provide sufficient vertically-extending space for the signal source used to achieve vertical polarization. Preferably, the upper ground member 121 and the lower ground member 123 are set as the top metal and bottom metal respectively in the stacked metal layer 105, and a second signal source 125 extends vertically toward one of the upper ground member 121 and the lower ground member 123 to excite the vertically polarized antenna.

In the embodiment, the pattern of the upper ground member 121 and the lower ground member 123 is not limited to the rectangular shown as shown in FIG. 5. Any proper pattern conforming to the characteristic of 0-degree and 180-degree phase, 170~190-degree phase differences or 180-degree phase differences to the propagating direction of electromagnetic wave is adoptable, as long as they are in up-down symmetry and energy radiation can be propagated in positive and negative Z-axis direction in extremely slim spacing between the upper and lower ground members 121, 123 for vertical polarization.

Refer still to FIGS. 4-6. The second signal source 125 for vertical polarization is provided in the antenna module. The second signal source 125 extends from the back portion 101*b* of the substrate 101 to the front portion 101*a* through a second opening 103*b* on the reflector 103, as shown in FIG. 5. More specifically, the path of second signal source 125 starts in the middle of and extends preferably perpendicularly to nearly opposite edge of the ground plane. The whole second signal source 125 should completely extend between the upper ground member 121 and lower ground member 123 and should not out of range thereof. The energy emitted from the second signal source 125 would couple the radiator and is transmitted to the upper and lower ground member 121, 123 thereof to generate resonance and radiation effect. Accordingly, the energy of electromagnetic wave is propagated in vertically polarizing direction. In the embodiment of present invention, as shown in FIG. 6, the second signal source 125 may be a part of the metal layer 105 extending horizontally from the reflector 103, with its pattern defined concurrently with the reflector 103 by photolithography, and the shape of second signal source 125 may be variant to increase impedance matching.

Refer still to FIGS. 4-6. Regarding the back portion 101*b*, similarly, a second shielding space 127 is formed by encircling multiple stacked metal layers 105 and first vias 107. In the embodiment, the second signal source 125 has vertical portions 125*a* extending vertically from the bottom in the second shielding space 127 and in the spacing between the upper and lower ground member 121, 123. The vertical portion 125*a* of the second signal source 125 and the encircling stacked metal layers 105 may establish a kind of coaxial cable transmission with better shielding and noise immune characteristics. One end of the vertical portion 125*a* extends horizontally to the front portion 101*a* through the second opening 103*b*, while the other end of the vertical portion 125*a* may electrically connect to the circuit module of the antenna, such as a radio frequency integrated circuit (RFIC) on the back portion 101*b* or a printed circuit board of an electronic communication device. Similarly, the vertical portion 125*a* of second signal source 125 may be made up of multiple stacked vias formed in the same process as the first vias 107.

In addition to the upper and lower ground member 121, 123 and the second signal source 125, an auxiliary ground plane 129 may be placed between the second upper ground plane 121 and the second lower ground plane 123 and in a position right under the second signal source 125 (or right above the signal source if the signal source extends downwardly). The area of auxiliary ground plane 129 is preferably slightly larger than the portion of the second signal source 125 in the front portion 101*a* to adjust the impedance matching.

In some embodiment, please refer to FIG. 6, the antenna structure may further include terminals (or connectors, not shown) and circuit module disposed in the back portion 101*b*. The grounding pad and the feeding pad 130 of each antenna may be electrically connected to a circuit module 132, for example, a phase shifter IC. The circuit module may further electrically connected to terminals to connect with the communication unit of an external communication device to implement wireless communication. In the application of antenna array, the phase shifter IC may function to adjust the field pattern and direction of entire antenna to achieve better communication efficiency.

The embodiment described above is the concept of vertically polarized antenna in the antenna structure of present invention. Now, please refer to FIGS. 7-9, which schematically illustrate the concept of the multilayer stacked antenna structure 130 with integrated horizontally polarized antenna module and vertically polarized antenna module in perspective view, top view and cross-sectional view respectively according to the preferred embodiment of the present disclosure. The main purpose of present invention is to provide a multilayer stacked antenna structure with well-integrated horizontally polarized antenna module and vertically polarized antenna module, in order to provide optimized radiation performance of the antenna module in dual polarization manner without mutual interference and make the best use of confined space in compact electronic devices. This antenna structure 130 combines the structures of aforementioned horizontally polarized antenna structure 100 and vertically polarized antenna structure 120 into a volume of substrate 101 same as the embodiments of horizontally polarized antenna module and vertically polarized antenna module, so that the antenna density in unit volume is effectively double.

Refer to FIGS. 7-9. The antenna structure 130 with integrated horizontally polarized antenna module and vertically polarized antenna module is provided with all of the components describe in the embodiment of FIGS. 1-3 and FIGS. 4-6, including the wall-type reflector 103, the pair of dipoles made up of the positive ground member 109 and the negative ground member 110, the upper and lower member 121 and 123, the first signal source 117 and the second signal source 125. Specifically, as shown in FIG. 9, since the second signal source for vertically polarized antenna requires sufficient vertically extending space, the upper dipole 113 and the lower dipole 115 of horizontally polarized antenna module are preferably set between the upper and lower ground members 121 and 123. More specifically, the pair of dipoles 113 and 115 is set at a horizontal level half height of the reflector 103 to ensure effective energy reflection by the reflector 103, while the upper and lower ground members 121, 123 are set as the top metal and bottom metal respectively of the stacked metal layer 105 to provide sufficient extending space.

Refer still to FIGS. 7-9. Since the first signal source 117 for the horizontally polarized antenna needs to extend across the slot 111 between the positive ground members 109 and the negative ground members 110 of the dipoles 113 and 115, the dipoles of horizontally polarized antenna would preferably extend farther than the upper and lower ground member 121, 123 of vertically polarized antenna from the reflector 103 to provide a proper path across the slot 111 without interfering with the second signal source 125 for vertically polarized antenna. Optionally, multiple second vias 131 are provided in connection with the upper and lower dipoles 113 and 115 along edges adjacent to the slot 111, and the second signal source 125 is disposed in the slot 111 between two rows of these second vias 131 respectively at the positive ground members 109 and the negative ground members 110 of the pair of dipoles 113 and 115. The first signal source 117 would across the slot 111 at a position farther than the row of second vias 131 from the reflector 130. The row of second vias 131 between the first signal source 117 and the second signal source 125 may function like a shielding to prevent the interference between vertically polarized source and horizontally polarized source and obtain better degree of isolation. Similarly, the first signal source 117 and the second signal source 125 extend respectively from the first shielding space 119 and the second shielding space 127 at back portion 101*b* through the first opening 103*a* and the second opening 103*b*.

Figure 10:
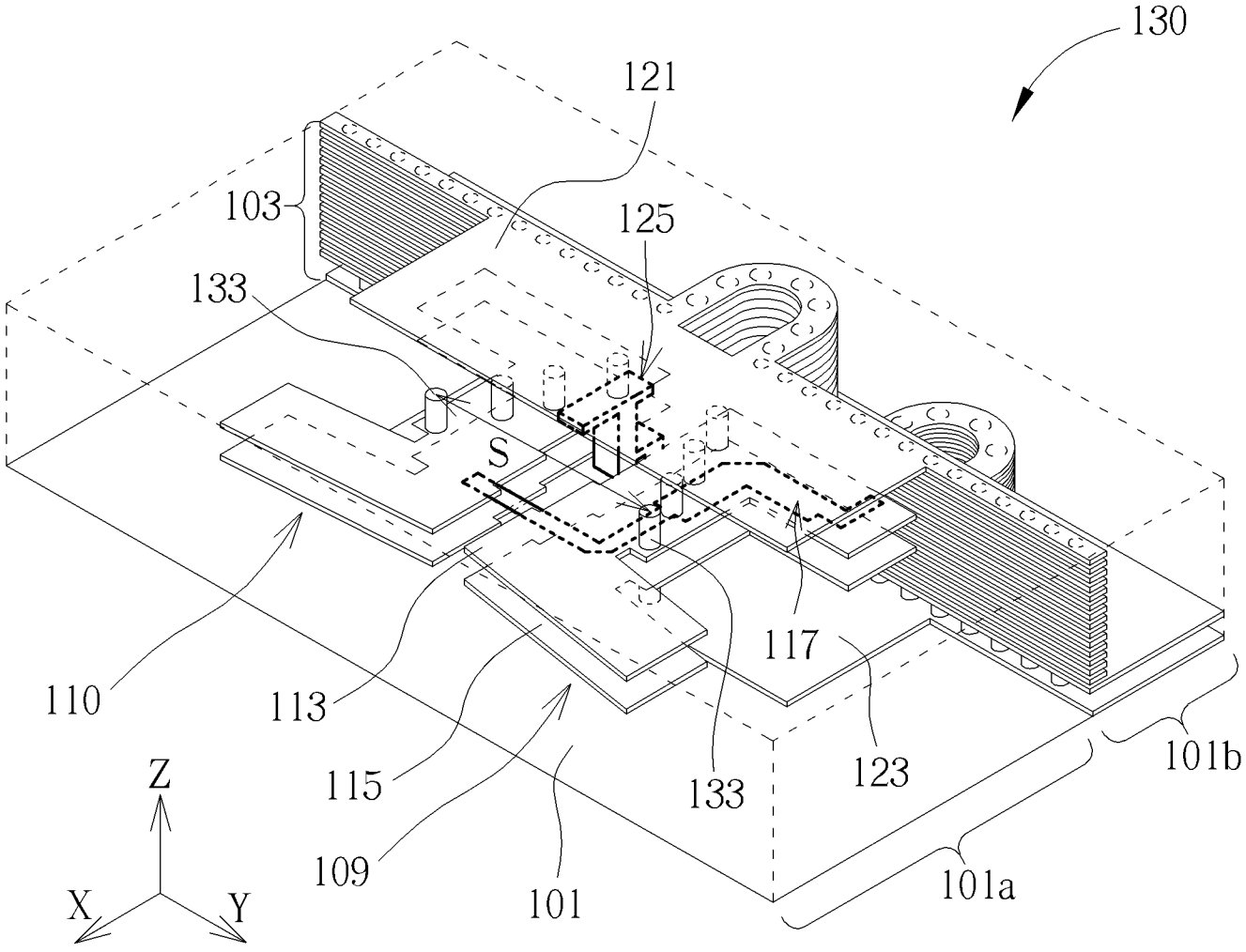
FIG. 10 is a schematic perspective view of the multilayer stacked antenna structure with integrated horizontally polarized antenna module and vertically polarized antenna module in accordance with another embodiment of the present invention.

Next, refer to FIG. 10, which schematically illustrates a perspective view of the multilayer stacked antenna structure with integrated horizontally polarized antenna module and vertically polarized antenna module in accordance with another embodiment of the present invention. Some components may be added into the antenna structure to further improve the propagation of radiating wave. As shown in FIG. 10, the antenna structure 130 may be provided with two rows of third vias 133 respectively at the positive ground members 109 and the negative ground members 110 of the pair of dipoles 113 and 115. Specifically, the third vias 133 in the embodiment are disposed between the positive ground member (plane) 109 and the negative ground member (plane) 110 of the upper dipole 113 and the upper ground member 121 and between the positive ground member (plane) 109 and the negative ground member (plane) 110 of the lower dipole 115 and the lower ground member 123, and a spacing S between the two rows of third vias 133 is gradually increased from the second opening 103*b* to the other end of radiators to create a horn-shaped via arrangement. This kind of horn structure standing between the ground planes may amplify the propagation of radiating wave in specific direction, while in this case, in X-axis direction against the reflector 103. The third via 133 is preferably not disposed between the upper dipole 113 and the lower dipole 115 in case of blocking the path of first signal source 117. Similarly, the third vias 133 may be made up of multiple stacked vias formed in the same process as the first vias 107.

Figure 11:
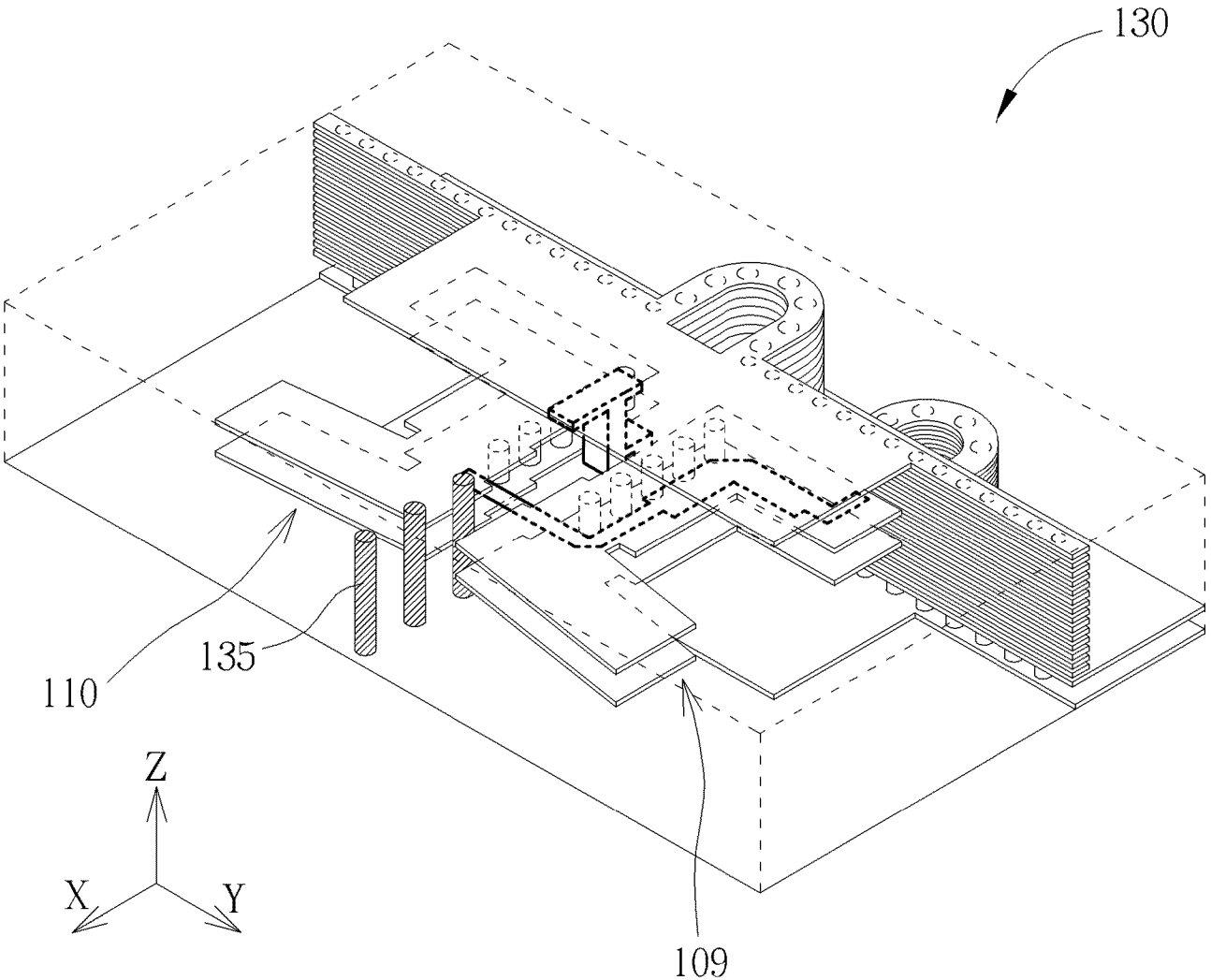
FIG. 11 is a schematic perspective view of the multilayer stacked antenna structure with integrated horizontally polarized antenna module and vertically polarized antenna module in accordance with still another embodiment of the present invention.

Next, please refer to FIG. 11, which schematically illustrates a perspective view of the multilayer stacked antenna structure with integrated horizontally polarized antenna module and vertically polarized antenna module in accordance with another embodiment of the present invention. A row of vertically-extending column directors 135 may be provided between the positive ground members (planes) 109 and the negative ground members (planes) 110 of the pair of dipoles and selectively aligned with the second signal source 125. Theses column directors 135 may improve the gain of vertically polarized antenna module. Similarly, the column directors 135 may be made up of multiple stacked vias formed in the same process as the first vias 107.

Figure 12:
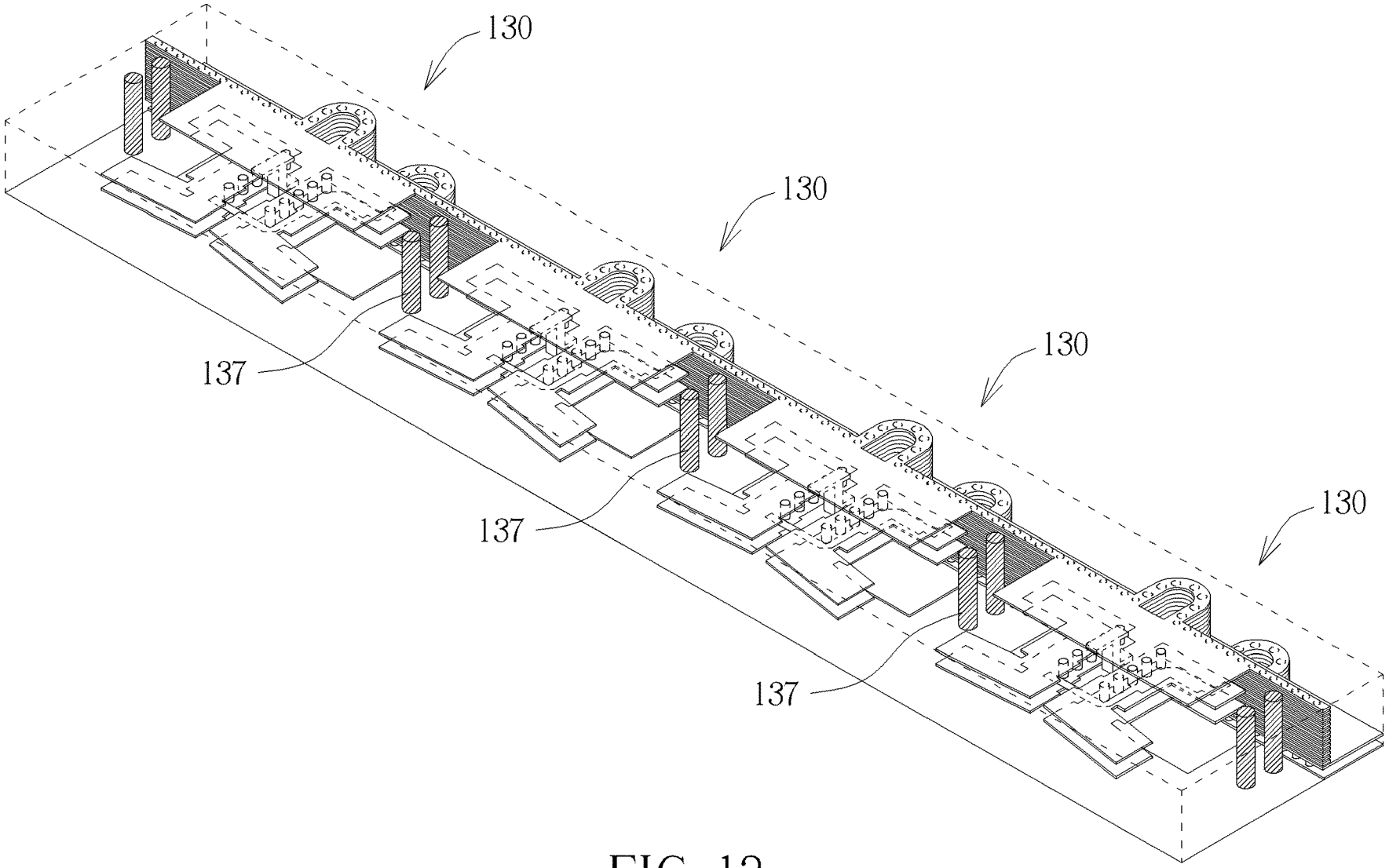
FIG. 12 is a schematic perspective view of an antenna array with arranged antenna structure in accordance with still another embodiment of the present invention.

Next, please refer to FIG. 12, which schematically illustrates a perspective view of an antenna array with multiple arranged antenna structures 130 in accordance with still another embodiment of the present invention. The antenna structures 130 with integrated horizontally polarized antenna and vertically polarized antenna may be arranged in a phased array manner to implement the beam forming, multi-input multi-output (MIMO) and millimeter wave (mmWave) technologies for 5G mobile networks or wireless system. Fourth vias 137 provided between each antenna structures 130 may function as a shielding to prevent mutual interference and improve the degree of isolation between the antenna structures 130. Similarly, the fourth vias 137 may be made up of multiple stacked vias formed in the same process as the aforementioned via structure.

Figure 13:
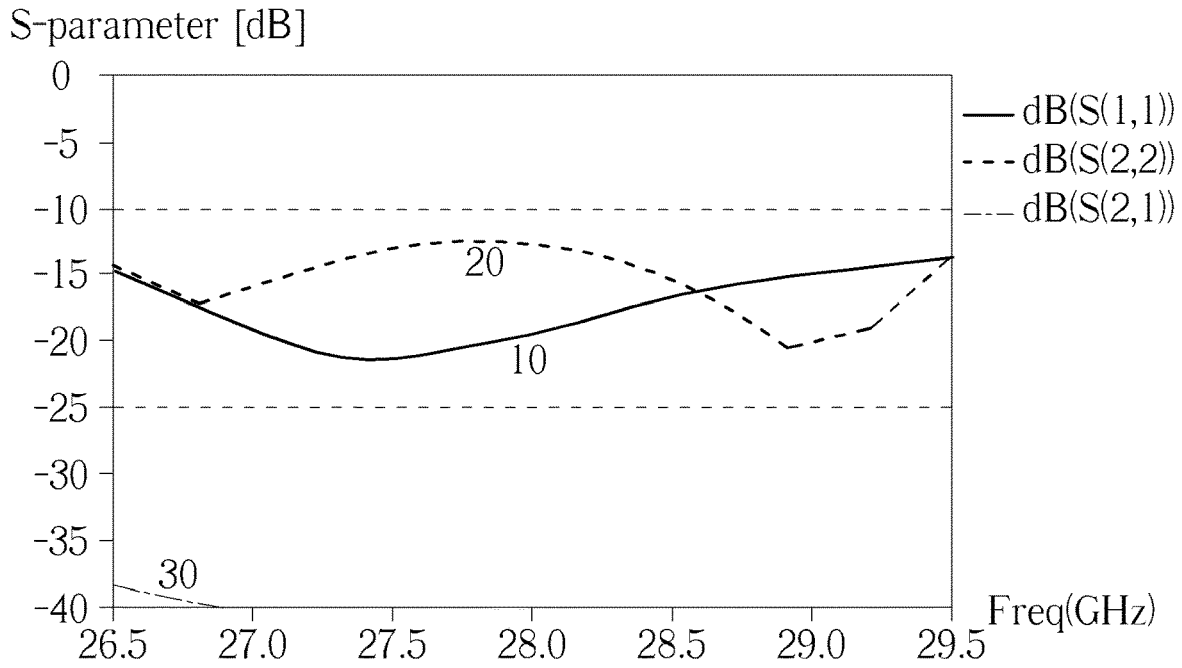
FIG. 13 is a graph illustrating the reflection coefficients (i.e. return loss) and isolation performance according to a frequency of the antenna structure included in an electronic device in accordance with the embodiment of the present invention.

Please refer to FIG. 13, which schematically illustrates a graph of a reflection coefficient (i.e. return loss) and isolation in a circuit of two-port network according to a frequency of the antenna structure 130 in accordance with the embodiment of the present invention. The solid line 10 represents the reflection coefficient dB(S(1,1)) of port 1 when matching with port 2. The dash line 20 represents the reflection coefficient dB(S(2,2)) of port 2 when matching with port 1. The chain line 30 represents the forward transmission coefficient dB(S(2,1)) from port 1 to port 2 when matching with port 2. It is indicated in the figure that the reflection coefficients dB(S(1,1)) and dB(S(2,2)) are both less than −10 dB at the target frequency about 26.5-29.5 GHz. As such, it may be verified that the performances of the integrated horizontally polarized and vertically polarized antenna structure 130 is sufficient to radiate a signal at target frequency. In addition, it is indicated in the figure that the forward transmission coefficient dB(S(2,1)) is less than −25 dB at the target frequency. As such, it may be verified that the horizontally polarized antenna structure 100 and the vertically polarized antenna structure 120 are electrically and sufficiently isolated from each other.

Figure 14:
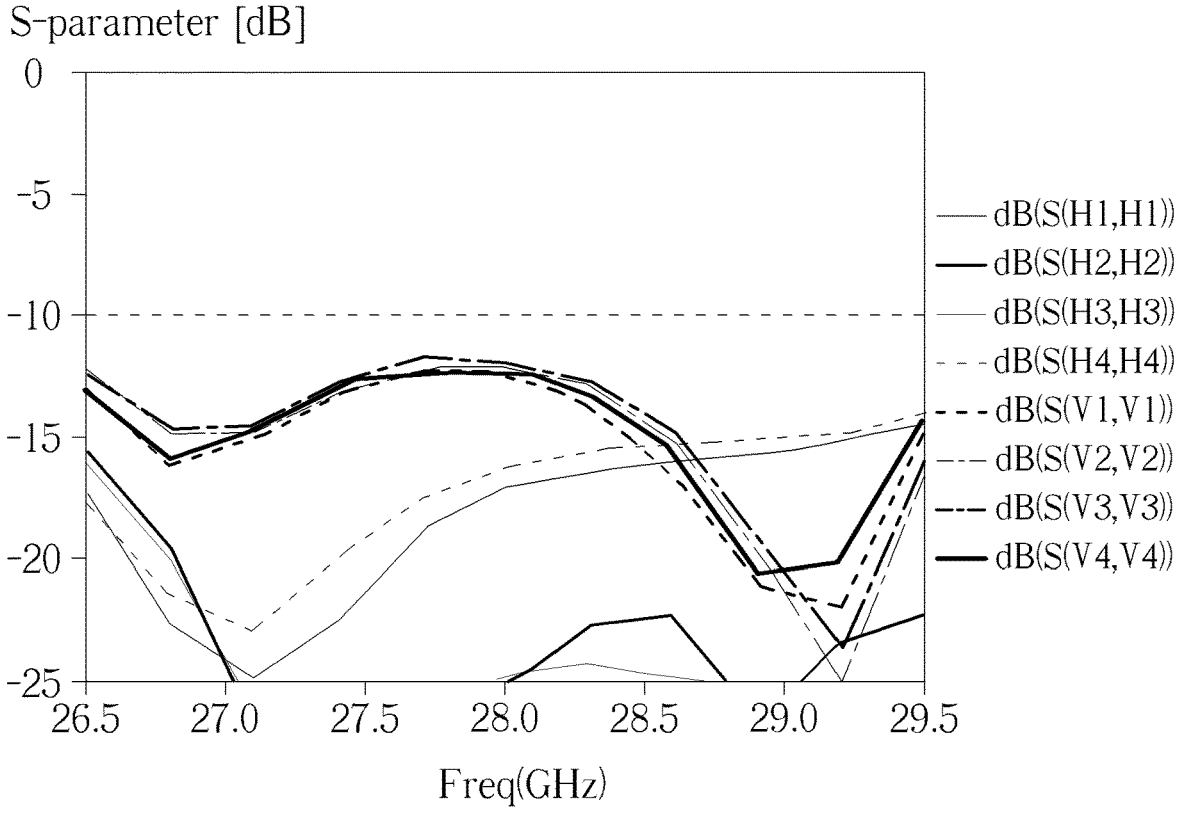
FIG. 14 is a graph of the reflection coefficients and isolation performance according to the 1×4 antenna array shown in FIG. 12 in accordance with the embodiment of the present invention.

Please refer to FIG. 14, which schematically illustrates a graph of a reflection coefficient (i.e. return loss) and isolation according to a frequency of 1×4 antenna array shown in FIG. 14 in accordance with the embodiment of the present invention. In the figure, the dB(S(H1,H1)) to dB(S(H4,H4)) represent the reflection coefficient of horizontally polarized antenna in four antenna structures 130, while dB(S(V1,V1)) to dB(S(V4,V4)) represent the reflection coefficient of vertically polarized antenna in four antenna structures 130. It is indicated in the figure that the eight reflection coefficients about the horizontally and vertically polarized antenna are all less than −10 dB at the target frequency about 26.5-29.5 GHz. As such, it may be verified that the performances of integrated horizontally polarized and vertically polarized antenna structure 130 is sufficient to radiate a signal at target frequency.

According to the structures and graph data described in the aforementioned embodiments. The multilayer stacked antenna structure provided by the present invention efficiently integrates the horizontally polarized antenna module and the vertically polarized antenna module in confined space. The return loss and transmission coefficients indicate the integrated antenna structure has optimized radiation performance, even in array arrangement, to meet the requirement of next-generation wireless communication technologies Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna structure, comprising:

a reflector dividing said antenna structure into a front side and a back side;

a horizontally polarized antenna on said front side of said reflector, wherein said horizontally polarized antenna comprises a pair of dipoles at least partially overlapping each other, and each said dipole comprises a positive ground member and a negative ground member separated by a slot;

a first signal source extending from a back side of said reflector to said front side through a first opening of said reflector, wherein said first signal source extends between said dipoles and extends from one overlapping interval between said positive ground members of said dipoles to another overlapping interval between said negative ground members of said dipoles across said slot to excite said horizontally polarized antenna;

a vertically polarized antenna on said front side of said reflector, wherein said vertically polarized antenna comprises a upper ground member and a lower ground member at least partially overlapping each other, wherein said upper ground member is above upper said dipole and said lower ground member is below lower said dipole; and a second signal source extending from said back side of said reflector to said front side through a second opening of said reflector, wherein said second signal source extends between said upper ground member and said lower ground member and extends vertically toward one of said upper ground member and said second lower ground member to excite said vertically polarized antenna.

2. The multilayer stacked antenna structure according to claim 1, wherein said reflector is made up of multiple stacked metal layers connected by first vias.

3. The antenna structure according to claim 2, wherein said horizontally polarized antenna and said vertically polarized antenna are horizontally-extending portions of said multiple stacked metal layers of said reflector.

4. The antenna structure according to claim 1, wherein said pair of dipoles is symmetrical with respect to and horizontally separated by said slot.

5. The antenna structure according to claim 1, further comprising an auxiliary ground plane between said upper ground member and said lower ground member and right under or right above said second signal source.

6. The antenna structure according to claim 2, wherein said reflector further comprises a first space encircled by said multiple stacked metal layers and said first vias on said back side and connecting to said first opening, and said first signal source extends vertically in said first space and through said first opening to said front side of said reflector.

7. The antenna structure according to claim 2, wherein said reflector further comprises a second space encircled by said multiple stacked metal layers and said first vias on said back side and connecting to said second opening, and said second signal source extends vertically in said second space and through said second opening to said front side of said reflector.

8. The antenna structure according to claim 1, wherein said first signal source and said second signal source are electrically connected to a circuit module on said back side of said reflector.

9. The antenna structure according to claim 1, wherein vertically extending portions of said first signal source and said second signal source are made up of vias.

10. The antenna structure according to claim 1, wherein said second opening connects to said slot.

11. The antenna structure according to claim 10, further comprising second vias connecting said positive ground member and said negative ground member along edges of said dipoles adjacent to said slot, and said second signal source is disposed in said slot and between two rows of said second vias respectively at said pair of dipoles.

12. The antenna structure according to claim 11, wherein said second signal source and said first signal source are separated and decoupled by one said row of said second vias.

13. The antenna structure according to claim 10, further comprising two rows of third vias respectively at said pair of dipoles, wherein said third vias are disposed between upper said dipole and said upper ground member and between lower said dipole and said lower ground member, and a spacing between said two rows of said third vias is gradually increased from said second opening to create a horn-shaped via arrangement.

14. The antenna structure according to claim 1, further comprising a row of vertically-extending column directors disposed between said pair of dipoles and aligned with said second signal source.

15. The antenna structure according to claim 1, wherein said pair of dipoles are symmetrical, and said positive ground member and said negative ground member are ground planes.

16. The antenna structure according to claim 1, wherein said positive ground member and said negative ground member are provided respectively with opposite extending structures in horizontally extending direction.

* * * * *